United States Patent [19]

Karpe et al.

[11] 4,233,479

[45] Nov. 11, 1980

[54] SWITCH

[75] Inventors: Wolfgang Karpe; Johannes Kluge, both of Wetter; Klaus-Dieter Oemus, Hemer, all of Fed. Rep. of Germany

[73] Assignee: Mannesmann Demag AG, Fed. Rep. of Germany

[21] Appl. No.: 25,933

[22] Filed: Apr. 2, 1979

[30] Foreign Application Priority Data

Apr. 10, 1978 [DE] Fed. Rep. of Germany ..... 2815493

[51] Int. Cl.[3] ..... H01H 15/18; H01H 3/12; H01H 13/04

[52] U.S. Cl. ..... 200/77; 200/159 R; 200/303; 200/321

[58] Field of Search ..... 200/321, 323, 324, 325, 200/340, 247, 159 R, 16 A, 330, 331, 68, 77, 303

[56] References Cited

U.S. PATENT DOCUMENTS

| | | | |
|---|---|---|---|
| 1,158,955 | 11/1915 | Apple et al. | 200/77 |
| 2,347,874 | 5/1944 | Bluemle | 200/77 |
| 2,386,162 | 10/1945 | Hetherington | 200/77 |
| 2,814,681 | 11/1957 | White | 200/159 R X |
| 3,855,558 | 12/1974 | Hayward | 200/303 X |
| 4,029,916 | 6/1977 | Chu | 200/340 X |
| 4,154,996 | 5/1979 | Arnold | 200/159 R X |

FOREIGN PATENT DOCUMENTS 1515570 8/1969 Fed. Rep. of Germany .

*Primary Examiner*—Steven M. Pollard
*Attorney, Agent, or Firm*—Mandeville and Schweitzer

[57] ABSTRACT

A step control switch for variable speed electric motors and the like is provided in which several spring forces are utilized in various combinations in order to reduce the velocity of the thrust force of the control button in either increasing or decreasing the speed of the device being controlled. By utilizing a spring between the push button and the control body of the switch which is placed under an initial stress, and countering the force of that spring with several combinations of springs in the opposite direction, a smooth transition is achieved among the several positions of the switch.

8 Claims, 8 Drawing Figures

SWITCH

BACKGROUND AND DESCRIPTION OF THE INVENTION

The invention refers to a switch element with a push button for axial displacement of a contact carrier provided with contacts, which is contained in a housing, and charged or maintained by a return spring in zero position, and which is further equipped with notches or catches for receiving lock-in elements urged into the notches by lock springs.

The switch element according to German Patent DE-OS No. 2056 943 is a terminal or boundary switch, and has only one on- and off-position, and no other switch positions, as required for shifting different speeds of motors. The contact carrier or portion of this switch element protrudes with one actuator end, from the housing, and may there be operated directly by a machine part, but not however, by a finger or thumb, since it jumps abruptly into another position when exceeding dead center. When pressing down, it suddenly gives, which might be tolerable. However, when releasing or returning it has a sudden acceleration, which would manifest itself as a blow on the finger or the thumb.

Another single-stage terminal switch with spring-loaded push button in a series spring circuit is disclosed in German Patent DE-AS No. 1190 088. The positions of the spring circuit are maintained by permanent magnets. The spring circuit operates the electric terminal switch whose contacts are spring-loaded for fast spark-over. This arrangement is very involved and is also suitable for two switch positions only, not for stepped changes in speed.

It is therefore the object of this invention to provide an easily operable stepped switch element with a spring circuit for several switch positions. The push button is at rest or in off position via an initial stress spring mounted on the contact carrier or body for the switch. The carrier has notches provided in succession for several switch positions in the direction of movement of the contact carrier. The operator depresses the push button with his thumb, and thereby cocks the initial stress spring. Upon exceeding a predetermined pressure the contact carrier jumps to the next switch position, whereby the initial stress spring is released and the return spring is cocked. Although this changes the counter-pressure of the push button on the thumb, it does not disappear suddenly which would have an unpleasant effect. With further increase in pressure the initial stress spring is again cocked, and the lock springs are compressed, which upon passing the notch, drive the contact carrier into the next switch position and thereby further tense the return spring, while the initial stress spring is again released.

To shift back a motor controlled by the switch of the invention, the pressure on the push botton is reduced and the initial stress spring relaxes, while the contact carrier at first still remains in its position and the return spring is fully cocked. Only when the initial stress spring is almost relaxed the return spring force prevails over it, driving the contact carrier abruptly into the next notch, whereby the initial stress spring is again cocked. This is not felt as unpleasant by the thumb resting on the push button.

The notches are of varying depths. The notch for the rest position is the deepest and the most difficult to pass. Therefore, any slight and unintentional touch of the push button does not lead to the start-up of the motor. The notch for the second stage, i.e. for the overdrive, is the most shallow and can be left quickly for the first stage when relaxing the pressure on the push button.

As a further feature of the invention, the contact carrier is equipped with contacts of one switch position which are displaceable relative to the contacts of the other switch position. When actuating the push botton, all contact pairs, with the exception of one, are moved to reach the first switch position. However, only two contact pairs reach the respective contact junctions, while the other contact pair requires further movement of the push button and the contact carrier before it reaches the second switch position, at which time all contacts are closed for the supply of current.

Each contact pair is supported on each other by contact springs and guided in contact slots in the contact carrier in the direction of motion of the latter. In their terminal positions, the contacts adhere to contact junctions firmly attached in the switch element. Between contacts and contact stops of the contact carrier limiting the movement of the contacts in the latter, an initial stress distance is found. This initial stress distance facilitates partial relaxation of the contact spring when displacing the contact carrier in release or off direction of the respective closed contact. This relaxation is necessary, since during shifting of the contact carrier from one position to another the contacts must be removed suddenly from the contact junctions. A cocked contact spring would prevent this or at least make it more difficult. The initial stress distance is greater than half the distance between the rest cams forming the notches. The moment of the switch-over is thus always determined by the lock-in elements when jumping from one notch to another, and not by the springs whose strength can never be exactly determined, and whose force rations do not change abruptly.

As a further feature of the invention, the force of the return spring, several of which may be arranged side by side acting in conjunction upon the contact carrier, as well as the force of all contact springs and the force of the lock spring affecting the switch cam and checking its movement, in relaxed condition is weaker than the force of the initial stress spring when the latter is cocked. Upon passing the switch point, the contact springs are relaxed and the return springs are cocked. The contact springs will tense themselves again, while the return springs always remain cocked during the on-position. Their relaxation is prevented by the lock springs and the terminal pressure of the initial stress spring reduced by the switch path of the contact carrier. The initial stress spring is, at low tension, under such minor initial stress that, despite the support by the lock springs, it is weaker than the force of the return springs, which temporarily also tense the two opposite lock springs.

Preferably, pressure bases or extensions extend between the push button and the contact carrier for limiting the engagement of these parts. They maintain the functioning of the contacts of the first switch stage of the switch element even during breakage or fatigue of the initial stress spring, and forcibly effect the motion of the contact carrier. The pressure bases are arranged on the push button and guided in grooves of a push button borehole of the switch body cover plate. The latter has restrictive stops for the pressure bases or extensions, so that the push button cannot be pushed out of the switch body by the initial stress spring. The restrictive stops keep the initial stress spring adhering to the push button under a low initial stress at all times. Also, the contact carrier is arranged in a base body of the switch element. Its cover plate, which is screwed on, houses the push button in a borehole. This division makes assembly of the switch element with its mountings easy. The contact junctions and the contact carrier are inserted into the standing base, and the initial stress spring with push button are placed on the contact carrier. The cover plate is placed with the borehole over the push button and screwed to the base. The cover plate also keeps the U-shaped guides for the lock-in elements in the base body so as to keep the lock-in elements pressed into the notches on the contact carrier by the lock springs. Each U-shaped piece is provided at the inside of the flanges with guiding grooves for pegs or pins of the lock-in element as well as for a thrust bearing, between the lock-in element and the lock spring. At the end opposite the lock-in element, the U-shaped piece further has a peg for the lock spring. The contact junctions are inserted into grooves in the base of the switch.

An example of the invention is shown on the drawings and explained as follows.

DETAILED DESCRIPTION OF THE INVENTION

Figure 1:
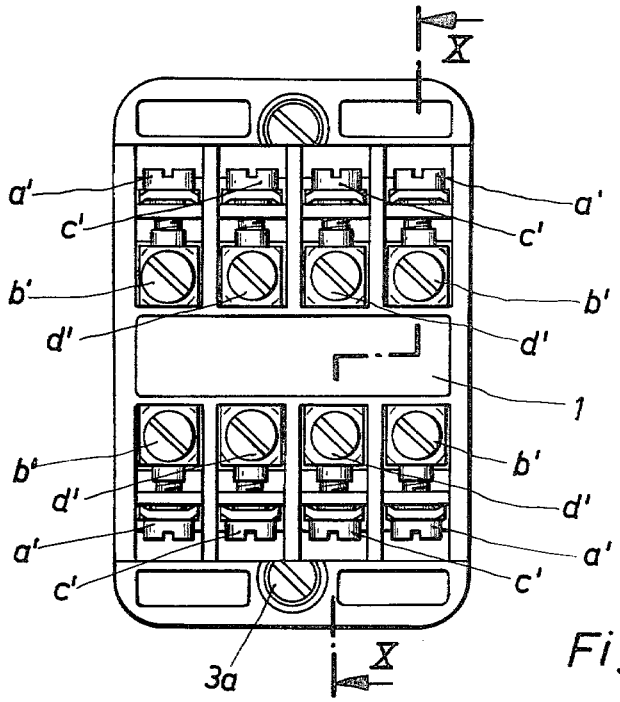
FIG. 1 is a bottom plan view of the switch of the invention.

Referring to the drawings, in which like reference characters refer to like parts throughout the several views thereof, the switch element of the invention has a base 1 and a cover plate 2 screwed on at the four corners with screws 3. The plate 2 contains a borehole 2*a* for push button 4 resting via initial stress spring 5 on a contact carrier 7 contained in base 1. The switch element or body is attached with screws 3*a* into a switch housing, not shown. In FIG. 1, screws a'-d' of upper contact junctions a and c as well as lower contact junctions b and d are to be seen.

Figure 2:
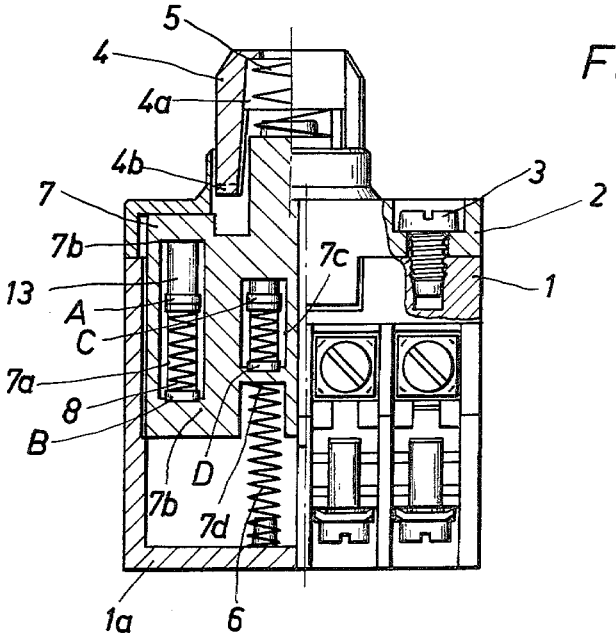
FIG. 2 is a side elevational view of the invention, partially in section to show the contact carrier of the invention.
Figure 3:
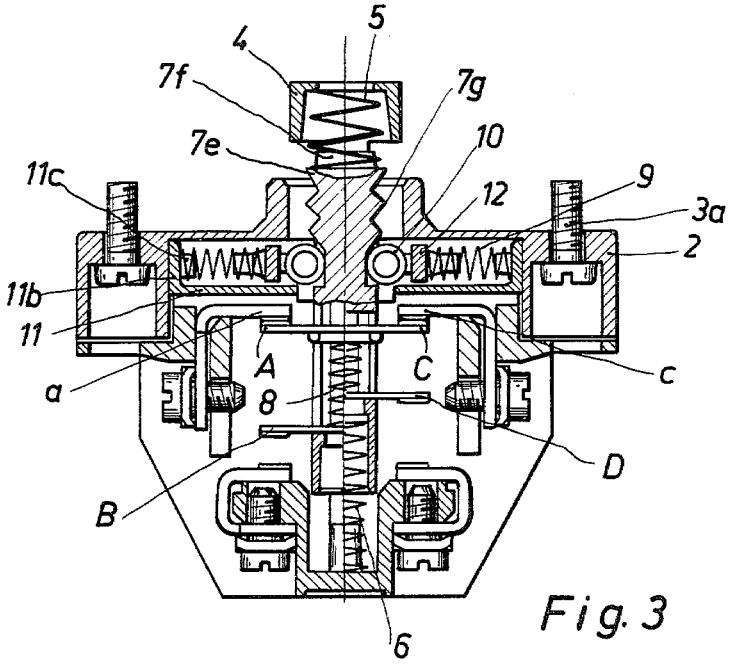
FIG. 3 is a sectional view taken along lines X—X of FIG. 1, and showing the parts of the switch in rest position.
Figure 6:
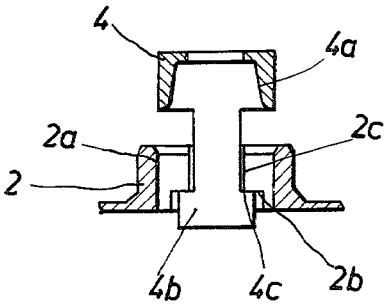
FIG. 6 is a partial sectional view of a portion of FIG. 3 showing the relationship between the push button and contact carrier.

Contact carrier 7, shown in FIGS. 2 and 3 is maintained with its contacts A, B, C, and D held in rest position by two side-by-side return springs 6 resting on the bottom 1*a* of base 1, if push button 4 is not pressed down. Push button 4 has a spring borehole 4*a* for receiving the initial stress spring 5, and two pressure feet or extensions 4*b* shown in FIGS. 2 and 6, actuating contact carrier 7 in case of breakage of initial stress spring 5. The opening direction of motion of push button 4 is limited by initial stress stops 4*c*, shown in FIG. 6 on pressure extensions 4*b*, which engage push button supports 2*b* of cover plate 2 if push button 4 is not actuated.

The contact carrier 7, according to the example, has four contacts A, B, C and D displaceably arranged in the direction of motion of the contact carrier until coming to rest on contact junctions 7*b*. Two opposite contacts each, A and B and/or C and D are guided in contact slots 7*a*, and urged apart by contact spring 8, whereby contact stops 7*b* of contact carrier 7 and/or contact junctions a–d determine the final positions. Between contact junctions a and b and contact stops 7*b* there is an initial stress distance 13 balanced by contact spring 8. Spring boreholes 7*c* are provided in contact carrier 7 for contact springs 8, two of which simultaneously serve to receive and guide the return springs 6 adhering to bottom 7*d*.

Figure 7:
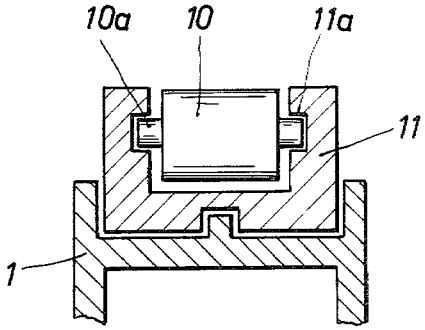
FIG. 7 is an enlarged cross sectional view of the U-shaped body for holding the spring-bias lock in detents of the invention.

According to FIG. 3, contact carrier 7 has, below push button 4, and superimposed on two opposite sides thereof three cams 7*g* for two switch positions. Between cams 7*g*, and below the lower cam there are notches of varying depth for roller-type lock-in elements 10, steadily held in the notches by lock springs 9 via interposed thrust bearings 12. Each lock-in element 10 is guided with thrust bearing 12 at right angles to the contact carrier 7 in grooves 11*a* of U-shaped profile piece 11, shown in FIG. 7, while its spring bottom 11*b* rests on lock spring 9 guided on peg 11*c*. Profile piece 11 adheres with spring bottom 11*b* to a stop, not shown, of base 1, and is secured in place by cover plate 2.

FIG. 3 shows the switch element with its contacts in off position according to cut X—X of FIG. 1. The off contacts A and C are subject to the effect of contact springs 8 at contact junctions a and c, while contacts B and D are without contact. Initial stress spring 5, as well as return springs 6, are cocked. Lock-in elements 10 are in the lower notch.

Figure 4:
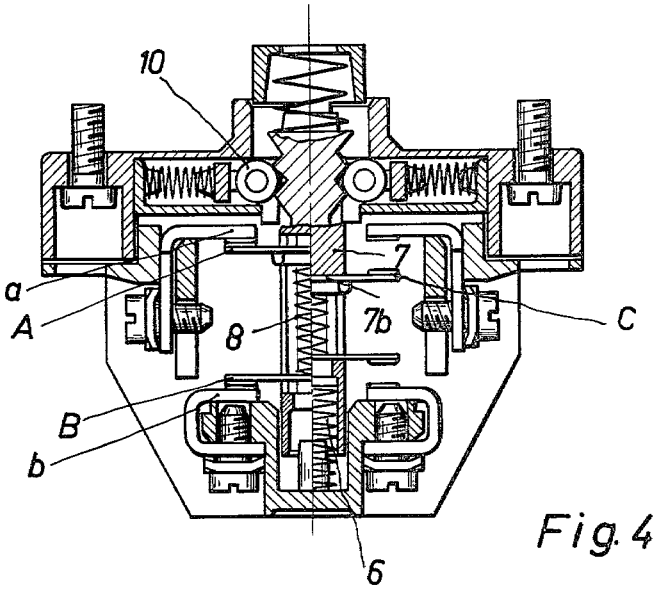
FIG. 4 is a sectional view taken along lines X—X of FIG. 1, but showing the parts of the switch in the first stage position.

FIG. 4 shows the switch element in the first stage. Contact C is opened by displacing contact carrier 7, and its contact stop 7*b*. Contact A is still under the effect of its relaxed contact spring 8, and adheres to contact junction a. Contact B adheres to contact junction b and is thus closed. Return springs 6 are slightly cocked. Lock-in elements 10 are in the central notch.

Figure 5:
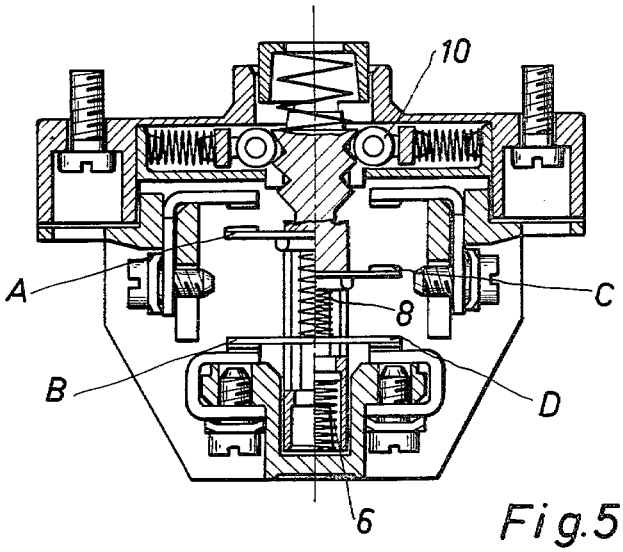
FIG. 5 is a view similar to FIG. 4, but showing the parts in the second stage position.

FIG. 5 shows the switch element in the second switch stage with opened contacts A and C as well as closed contacts B and D. Return springs 6, as well as contact springs 8, are strongly cocked. Lock-in elements 10 lie in the upper notch.

Initial stress spring 5 is only cocked at the beginning of the switch process. It relaxes again each time cams 7*g* have pushed back lock-in elements 10 against the pressure of lock springs 9 and lock-in elements 10 reach the desired notch. Contact springs 8 and return springs 6 are so strong that, when relaxing the pressure on the push button 4, they compress initial stress spring 5 and, furthermore, overcome the pressure of lock springs 9, and thus push back contacts A–D in stages to the starting positions.

Figure 8:
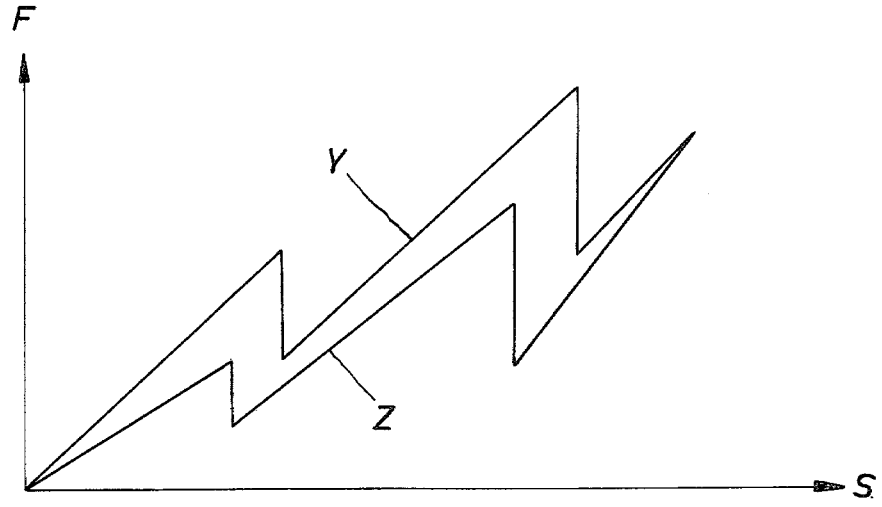
FIG. 8 is a graph showing the switch force versus the switch path of the switch of the invention.

FIG. 8 shows the diagram of switch path S and switch force F with path-force lines & for switch-on, and Z for switch-off of the motor. The switch points are recognized by sudden change in switch force F and are located within the unstable area of the actuating path.

We claim:

1. A stepped push button switch, comprising
(a) a housing body;
(b) a switch contact carrier displaceable in said body;
(c) a push button engaging said carrier;
(d) return spring means for maintaining said carrier in off position; the improvement characterized by
(e) a plurality of axially spaced notches on said carrier;
(f) spring biased lock-in elements for engaging sequentially said notches on said carrier;
(g) an initial stress spring disposed between said push button and said carrier;
(h) a top cover plate for said body;
(i) a bore in said cover plate for receiving said push button;
(j) opposed grooves in said body at right angles to the axis of said contact carrier and on eacn side thereof;
(k) a U-shaped guide disposed in each said groove;
(l) the legs of each U-shaped guide forming slots for receiving said lock-in elements;
(m) the springs of said lock-in elements received in said U-shaped guides;
(n) a thrust bearing disposed between each said lock-in element and its respective spring; and
(o) pegs disposed on each said thrust groove and the opposed wall of each said groove for receiving each end of the said springs of said lock-in elements.

2. The apparatus of claim 1, further characterized by
(a) said axially spaced notches are of varying depth.

3. The apparatus of claim 1, further characterized by
(a) a plurality of switch contact points for said switch contact carrier disposed in said body in axially spaced relation for engagement sequentially with said contact carrier.

4. The apparatus of claim 3, further characterized by (a) at least one axially extending slot in said contact carrier;
(b) at least one first contact spring disposed in said axially extending slot;
(c) one each of a pair of said spaced contact points positioned at each end of said first contact spring; and
(d) said first contact spring providing an initial stress distance between the opposed contact stops for said pair of spaced contact points.

5. The apparatus of claim 4, further characterized by
(a) said initial stress distance is greater than the cams forming the said axially spaced notches.

6. The apparatus of claim 5, further characterized by
(a) at least one return spring disposed between the base of said body and said switch contact carrier;
(b) the combined strength of said contact spring, said spring-biased lock-in elements and said return spring in relaxed state is less than the strength of said initial stress spring; and
(c) the combined strength of said contact spring and said return spring is greater than said initial stress spring in relaxed state with the strength of said spring-biased lock-in elements interposed.

7. The apparatus of claim 6, further characterized by
(a) axially extending limit extensions on said push button;
(b) said limit extensions for engaging said contact carrier; and
(c) said limit extensions limiting the axial displacement of said push button toward and away from said contact carrier.

8. The apparatus of claim 1, further characterized by
(a) a plurality of contact junctions in said body, and
(b) each said contact junction disposed in a groove in said body.

* * * * *